US005770917A

United States Patent [19]

Yano et al.

[11] Patent Number: 5,770,917

[45] Date of Patent: Jun. 23, 1998

[54] GENERAL-PURPOSE DISCHARGE LAMP AND GENERAL-PURPOSE LIGHTING APPARATUS

[75] Inventors: Tadashi Yano, Soraku-gun; Kenjiro Hashimoto, Osaka; Makoto Inohara, Katano, all of Japan

[73] Assignee: Matsushita Electric Industrial Co., Ltd., Kadoma, Japan

[21] Appl. No.: 700,273

[22] Filed: Aug. 20, 1996

[30] Foreign Application Priority Data

Aug. 24, 1995 [JP] Japan ..... 7-215842

[51] Int. Cl.[6] ..... H01J 1/62

[52] U.S. Cl. ..... 313/486

[58] Field of Search ..... 313/485, 486, 313/487

[56] References Cited

U.S. PATENT DOCUMENTS 5,122,710 6/1992 Northrop et al. ..... 313/487
5,525,860 6/1996 Horaguchi et al. ..... 313/487

FOREIGN PATENT DOCUMENTS 0594424 4/1994 European Pat. Off. .
0595627 5/1994 European Pat. Off. .
0596548 5/1994 European Pat. Off. .
62-029053 7/1987 Japan .

OTHER PUBLICATIONS

Hashimoto et al, Color Research and Application, John Wiley & Sons, Inc., vol. 19, No. 3, Jun. 1994, pp. 171–185, "Visual Clarity and Feeling of Contrast.".

Hashimoto, J. Illum. Engng. Inst. Jpn, vol. 79, No. 11, 1995, pp. 639–647, "New Method for Specifying Color Rendering Properties of Light Sources Based on the Feeling of Contrast.".

Search Report dated May 27, 1997 for European Patent Application No. 96112998.8.

*Primary Examiner*—George M. Dombroske
*Assistant Examiner*—Harshad Patel
*Attorney, Agent, or Firm*—Renner, Otto, Boisselle & Sklar, P.L.L.

[57] ABSTRACT

A general-purpose discharge lamp of the present invention has a reciprocal correlated color temperature Mr and an index for feeling of contrast M, wherein the index for feeling of contrast M and the reciprocal correlated color temperature Mr satisfy the relationships:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(MK^{-1}).$$

12 Claims, 12 Drawing Sheets

GENERAL-PURPOSE DISCHARGE LAMP AND GENERAL-PURPOSE LIGHTING APPARATUS

BACKGROUND OF THE INVENTION

1. Field of the Invention

The present invention relates to a general-purpose discharge lamp and a general-purpose lighting apparatus for preferably designing a color environment of indoor lighting.

2. Description of the Related Art

At present, a "method for specifying fidelity of color reproduction" is employed for quantitively assessing color rendering properties of a light source. This method is used for quantitively specifying the degree of fidelity of the color of an illuminant reproduced by a test lamp as compared with a standard illuminant, and is defined in "Method for specifying color rendering properties of light sources", CIE (Commission Internationale de l'Eclairage: International Commission on Illumination) Pub., 13.2 (1974). The color rendering properties are represented by the value of a general color rendering index Ra. Moreover, at present, discharge lamps have been developed so as to improve the general color rendering index Ra and a light efficacy.

Besides the assessment of fidelity of color reproduction, a "method of specifying preference of color reproduction" has been studied. According to this method, when the color reproduced by a test lamp is shifted from that of a standard illuminant, it is quantitively specified that the color shift occurs in a favorable direction or an unfavorable direction. Although the assessment of preference of color reproduction is one of the most important color rendering properties of a light source, a standardized method thereof has not been established yet. The method is to be standardized in further studies.

The preference of color reproduction is specified mainly for human skin color and colors of foods, perishable flowers and plants. Among them, a food display lamp for foods such as meat and fish and a plant lighting lamp for flowers and plants have already been developed. However, these lamps are so-called special-purpose lamps and the color of light reproduced by them is pinkish. Therefore, such a special-purpose lamp cannot be widely used as a general-purpose lamp.

In development of general-purpose lamps used for houses, offices and shops, it is essential to develop the lamps so as to have a distinguishable feature and to be capable of appropriately reproducing the colors of important objects in a lighting environment such as human skin, flowers, plants and walls. The inventors of the present invention particularly aimed to improve the preference of color reproduction of human skin, specified a preferable skin color region by means of experiments, and manufactured a discharge lamp for illuminating human skin with light having a preferable color (copending U.S. patent application Ser. No. 08/467,291).

On the other hand, regarding the color reproduction of objects other than human colors, for example, flowers and plants, the inventors of the present invention clarified that a lighting color environment can be assessed by using an index for feeling of contrast developed from the concept of feeling of contrast as an assessment criteria based on the result of years of study (for example, Visual Clarity and Feeling of Contrast, Color Research and Application, by Hashimoto et al., 19, 3, June, (1994); and "New Method for Specifying Color Rendering Properties of Light Sources based on the Feeling of Contrast" by Hashimoto et al., J. Illum. Engng. Inst. Jpn. Vol.79, No. 11, 1995).

However, since the assessment criteria such as an index for feeling of contrast has not been established, a discharge lamp and a lighting apparatus for making color objects such as flowers and plants look sufficiently beautiful and vivid in a general lighting environment have not been manufactured.

SUMMARY OF THE INVENTION

A general-purpose discharge lamp of the present invention has a reciprocal correlated color temperature Mr and an index for feeling of contrast M, wherein the index for feeling of contrast M and the reciprocal correlated color temperature Mr satisfy the relationships:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(MK^{-1}).$$

In one embodiment of the present invention, a color point of an illuminant color of the discharge lamp is present in such a range that a distance of the color point from a Planckian locus on a 1960 uv chromaticity diagram is greater than −0.003 and smaller than +0.010.

In another embodiment of the present invention, a color point of an illuminant color of the discharge lamp is present in such a range that a distance of the color point from a Planckian locus on a 1960 uv chromaticity diagram is greater than 0 and smaller than +0.010.

In still another embodiment of the present invention, the discharge lamp is a fluorescent lamp and includes a combination of a green phosphor and a red phosphor, or a combination of a blue phosphor, the green phosphor and the red phosphor, the blue phosphor having a peak wavelength in a wavelength band of 400 nm to 460 nm, the green phosphor having a peak wavelength in a wavelength band of 500 nm to 550 nm, and the red phosphor having a peak wavelength in a wavelength band of 600 nm to 670 nm.

In still another embodiment of the present invention, the blue phosphor is an $Eu^{2+}$-activated blue phosphor having a peak wavelength in a wavelength band of 400 nm to 460 nm, the green phosphor is a $Tb^{3+}$-activated or $Tb^{3+}$ and $Ce^{3+}$-coactivated green phosphor having a peak wavelength in a wavelength band of 500 nm to 550 nm, and the red phosphor is an $Eu^{3+}$-activated red phosphor or a $Mn^{2+}$ $Mn^{4+}$-activated red phosphor having a peak wavelength in a wavelength band of 600 nm to 670 nm.

In still another embodiment of the present invention, the discharge lamp is a fluorescent lamp and includes a combination of a blue-green phosphor, a green phosphor and a red phosphor, or a combination of a blue phosphor, the blue-green phosphor, a green phosphor, and the red phosphor, the blue phosphor having a peak wavelength in a wavelength band of 400 nm to 460 nm, the blue-green phosphor having a peak wavelength in a wavelength band of 470 nm to 495 nm, the green phosphor having a peak wavelength in a wavelength band of 500 nm to 550 nm, and the red phosphor having a peak wavelength in a wavelength band of 600 nm to 670 nm.

In still another embodiment of the present invention, the blue phosphor is an $Eu^{2+}$-activated blue phosphor having a peak wavelength in a wavelength band of 400 nm to 460 nm, the blue-green phosphor is an $Eu^{2+}$-activated blue-green phosphor having a peak wavelength in a wavelength band of 470 nm to 495 nm, the green phosphor is a $Tb^{3+}$-activated or $Tb^{3+}$ and $Ce^{3+}$-coactivated green phosphor having a peak wavelength in a wavelength band of 500 nm to 550 nm, and the red phosphor is an $Eu^{3+}$-activated red phosphor or a $Mn^{2+}$ or $Mn^{4+}$-activated red phosphor having a peak wavelength in a wavelength band of 600 nm to 670 nm.

According to another aspect of the invention, a general-purpose lighting apparatus of the present invention for emitting a lighting illuminant has an index for feeling of contrast M and a reciprocal correlated color temperature Mr, wherein the index for feeling of contrast M and the reciprocal correlated color temperature Mr satisfy the relationships:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(MK^{-1}).$$

In one embodiment of the present invention, the lighting apparatus includes a lamp, and at least one of reflecting plate and a transmitting plate.

In another embodiment of the present invention, the lighting apparatus includes a plurality of lamps.

Thus, the invention described herein makes possible the advantage of providing a general-purpose discharge lamp and a general-purpose lighting apparatus for obtaining a preferable lighting color environment particularly suitable for main lighting of a house, a shop, an office and the like.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples.

First, an index for feeling of contrast M which is independently developed by the inventors of the present invention will be described.

Figure 2:
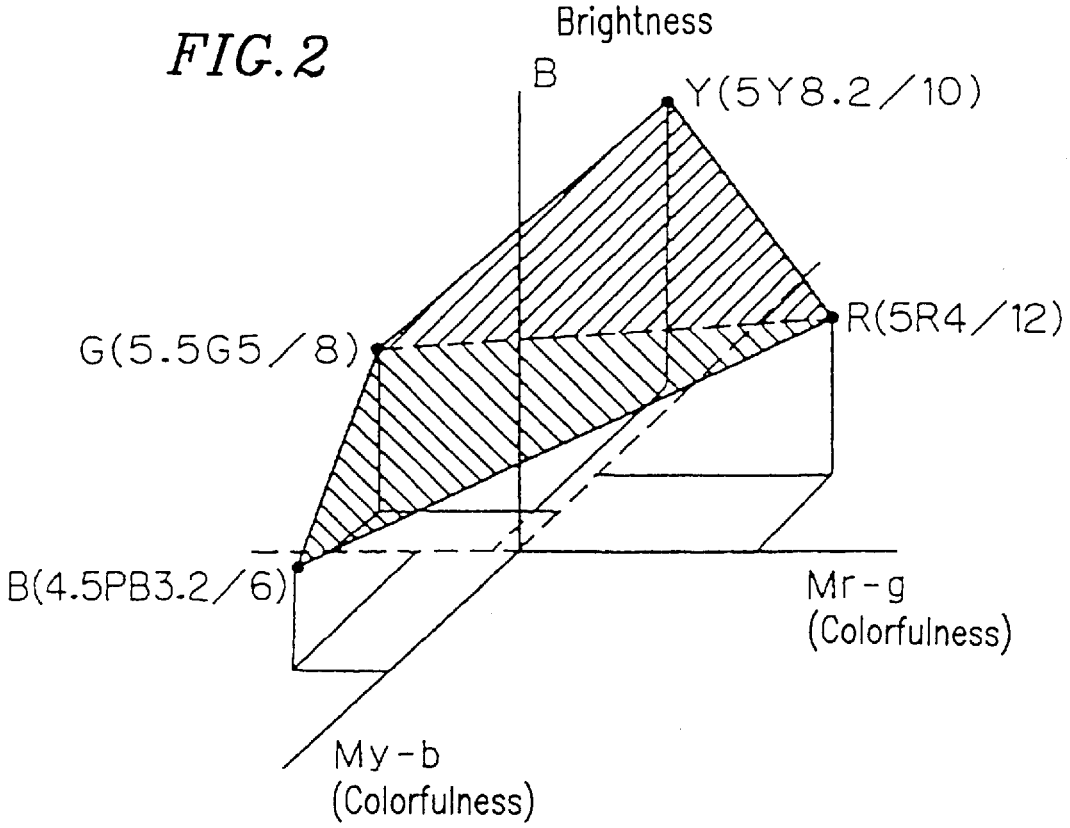
FIG. 2 shows an index for feeling of contrast M for illustrating the basic concept of the present invention.

As shown in FIG. 2, the degree of feeling of contrast of a color object illuminated by a lighting lamp is represented by a gamut area in the three dimensional space, consisting of brightness (B) and colorfulness (Mr-g, My-b) (for example, Nayatani et al., Color Research and Application, 20, 3, (1995)) of each component color (R, Y, G, B) of the four-color combination of a non-linear color appearance model by Nayatani et al. As the gamut area becomes greater, the degree of feeling of contrast is higher.

Table 1 shows spectral radiance factors of four test colors of the index for feeling of contrast M.

TABLE 1

| Wavelength (nm) | Red | Yellow | Green | Blue |
|---|---|---|---|---|
| 380 | 0.058 | 0.078 | 0.075 | 0.066 |
| 385 | 0.059 | 0.084 | 0.081 | 0.070 |
| 390 | 0.061 | 0.092 | 0.088 | 0.076 |
| 395 | 0.061 | 0.099 | 0.096 | 0.085 |
| 400 | 0.061 | 0.103 | 0.101 | 0.092 |
| 405 | 0.061 | 0.106 | 0.105 | 0.101 |
| 410 | 0.060 | 0.107 | 0.108 | 0.109 |
| 415 | 0.060 | 0.107 | 0.110 | 0.110 |
| 420 | 0.059 | 0.107 | 0.112 | 0.111 |
| 425 | 0.059 | 0.108 | 0.115 | 0.120 |
| 430 | 0.058 | 0.109 | 0.118 | 0.123 |
| 435 | 0.058 | 0.110 | 0.122 | 0.135 |
| 440 | 0.058 | 0.111 | 0.125 | 0.154 |
| 445 | 0.057 | 0.113 | 0.130 | 0.172 |
| 450 | 0.056 | 0.115 | 0.135 | 0.184 |
| 455 | 0.055 | 0.116 | 0.141 | 0.192 |
| 460 | 0.055 | 0.118 | 0.149 | 0.200 |
| 465 | 0.054 | 0.120 | 0.158 | 0.208 |
| 470 | 0.053 | 0.123 | 0.166 | 0.211 |
| 475 | 0.052 | 0.126 | 0.175 | 0.209 |
| 480 | 0.051 | 0.130 | 0.184 | 0.202 |
| 485 | 0.050 | 0.137 | 0.195 | 0.190 |
| 490 | 0.050 | 0.148 | 0.209 | 0.177 |
| 495 | 0.049 | 0.164 | 0.227 | 0.163 |
| 500 | 0.049 | 0.194 | 0.256 | 0.147 |
| 505 | 0.049 | 0.240 | 0.291 | 0.132 |
| 510 | 0.049 | 0.298 | 0.325 | 0.118 |
| 515 | 0.050 | 0.376 | 0.352 | 0.105 |
| 520 | 0.050 | 0.451 | 0.363 | 0.094 |
| 525 | 0.051 | 0.529 | 0.361 | 0.084 |
| 530 | 0.051 | 0.596 | 0.348 | 0.077 |
| 535 | 0.052 | 0.645 | 0.331 | 0.071 |
| 540 | 0.053 | 0.684 | 0.308 | 0.067 |
| 545 | 0.054 | 0.710 | 0.284 | 0.063 |
| 550 | 0.055 | 0.726 | 0.260 | 0.061 |
| 555 | 0.057 | 0.737 | 0.235 | 0.058 |
| 560 | 0.060 | 0.743 | 0.213 | 0.057 |
| 565 | 0.062 | 0.747 | 0.191 | 0.055 |
| 570 | 0.065 | 0.750 | 0.171 | 0.054 |
| 575 | 0.068 | 0.750 | 0.154 | 0.053 |
| 580 | 0.075 | 0.749 | 0.137 | 0.053 |
| 585 | 0.089 | 0.749 | 0.121 | 0.052 |
| 590 | 0.116 | 0.746 | 0.108 | 0.052 |
| 595 | 0.150 | 0.743 | 0.096 | 0.052 |
| 600 | 0.198 | 0.738 | 0.087 | 0.052 |
| 605 | 0.263 | 0.734 | 0.080 | 0.051 |
| 610 | 0.338 | 0.729 | 0.075 | 0.052 |
| 615 | 0.412 | 0.726 | 0.072 | 0.052 |

TABLE 1-continued

| Wavelength (nm) | Red | Yellow | Green | Blue |
|---|---|---|---|---|
| 620 | 0.489 | 0.723 | 0.071 | 0.052 |
| 625 | 0.555 | 0.721 | 0.070 | 0.052 |
| 630 | 0.603 | 0.720 | 0.069 | 0.052 |
| 635 | 0.641 | 0.719 | 0.069 | 0.052 |
| 640 | 0.665 | 0.718 | 0.069 | 0.052 |
| 645 | 0.682 | 0.718 | 0.069 | 0.052 |
| 650 | 0.694 | 0.717 | 0.069 | 0.052 |
| 655 | 0.703 | 0.718 | 0.069 | 0.052 |
| 660 | 0.708 | 0.719 | 0.070 | 0.052 |
| 665 | 0.713 | 0.721 | 0.072 | 0.051 |
| 670 | 0.716 | 0.723 | 0.073 | 0.051 |
| 675 | 0.718 | 0.725 | 0.074 | 0.051 |
| 680 | 0.720 | 0.727 | 0.076 | 0.051 |
| 685 | 0.722 | 0.729 | 0.077 | 0.051 |
| 690 | 0.724 | 0.730 | 0.079 | 0.051 |
| 695 | 0.726 | 0.732 | 0.080 | 0.051 |
| 700 | 0.731 | 0.734 | 0.081 | 0.052 |
| 705 | 0.733 | 0.734 | 0.081 | 0.053 |
| 710 | 0.738 | 0.735 | 0.081 | 0.054 |
| 715 | 0.742 | 0.735 | 0.080 | 0.056 |
| 720 | 0.746 | 0.734 | 0.080 | 0.058 |
| 725 | 0.751 | 0.734 | 0.080 | 0.060 |
| 730 | 0.754 | 0.736 | 0.081 | 0.062 |
| 735 | 0.756 | 0.736 | 0.083 | 0.064 |
| 740 | 0.758 | 0.740 | 0.086 | 0.067 |
| 745 | 0.760 | 0.742 | 0.090 | 0.071 |
| 750 | 0.763 | 0.744 | 0.094 | 0.077 |
| 755 | 0.765 | 0.747 | 0.098 | 0.089 |
| 760 | 0.766 | 0.747 | 0.102 | 0.106 |
| 765 | 0.769 | 0.749 | 0.105 | 0.129 |
| 770 | 0.770 | 0.750 | 0.108 | 0.155 |
| 775 | 0.773 | 0.750 | 0.110 | 0.176 |
| 780 | 0.774 | 0.749 | 0.112 | 0.193 |

Since a red component color greatly contributes to the feeling of contrast, the red component color is used as a reference. Therefore, the gamut area of four color components is determined by the sum of a triangular area consisting of a red component color, a blue component color and a green component color and a triangular area consisting of a red component color, an yellow component color and a green component color.

Based on the gamut area of four color components, the index for feeling of contrast M can be expressed by the following Equation 1.

[Equation 1]

$$M=[G(S,\ 1000(1x))/G(D_{65},\ 1000(1x))]^{1.6}\times 100$$

where G(S, 1000(1x)) is a gamut area of four color components under a test light source S and an illuminance 1000(1x), and $G(D_{65}, 1000(1x))$ is a gamut area of four color components under a standard illuminant $D_{65}$ and a standard illuminance 1000(1x).

More specifically, when the gamut area of four color components under an illuminant emitted from an arbitrary lighting lamp S is equal to that under an illuminant emitted from the standard illuminant $D_{65}$, that is, when the same feeling of contrast as that of the illuminant emitted from the standard illuminant $D_{65}$ is obtained, the index for feeling of contrast M of the lighting lamp S is normalized as 100.

Next, in order to specify such a range of the index for feeling of contrast M that a preferable lightning color environment suitable for a general-purpose discharge lamp used for main lighting in a house, a shop and an office is obtained, various fluorescent lamps having different indices for feeling of contrast are manufactured by way of experiment. With the sample fluorescent lamps, an experiment for assessment is carried out.

The sample lamps used for the experiment are manufactured by using a mixture of three colors of phosphors, i.e., a green phosphor, a blue phosphor and a red phosphor. For example, $LaPO_4:Ce^{3+},Tb^{3+}$ (represented as LAP in Table 2) is used as the green phosphor, $Sr_{10}(PO_4)_6Cl_2:Eu^{2+}$ (represented as SCA in Table 2) and $Sr_2\ P_2O_7:Eu^{2+}$ (represented as BA42N) are used as the blue phosphors, and $Y_2O_3:Eu^{3+}$ (represented as YOX in Table 2) and $3.5MgO.0.5MgF_2.GeO_2:Mn^{4+}$ (represented as MFG in Table 2) are used as the red phosphors.

The experiment is carried out in an observation booth which has the size of 170 (cm)×150 (cm)×180 (cm) and is provided with each of the sample lamps at a ceiling thereof. A wall, a floor and a desk have N8.5, N5 and N7, respectively. Test objects are placed on the desk. The test objects are: various flowers and plants of various colors such as crimson roses, red, pink and white carnations, yellow small chrysanthemums, violaceous to purplish red star thistles, and purple- or pink-trimmed white eustomas; a glass; a plaster figure; a hand mirror; a small tatami mat; a newspaper; a magazine; a tomato; a lemon; an orange; a green pepper; and 15 color charts. The experiment is carried out in the observation booth for each sample lamp having the same correlated temperature. The sample lamps are assessed based on the assessment criteria of whether or not the sample lamps is preferable as a general indoor lighting environment. Table 2 shows the sample lamps used for the assessment experiment and the results thereof.

TABLE 2

| No. | LAP | BA42N | SCA | SAE | YOX | MFG | Correlated color temperature | ◁uv | Index for feeling of contrast | Assessment |
|---|---|---|---|---|---|---|---|---|---|---|
| 1 | 26.5 | | 32.1 | | 8.1 | 33.1 | 8017 | −0.0018 | 123 | ○ |
| 2 | 27.6 | | 32.9 | | 11.6 | 27.9 | 7983 | −0.0006 | 116 | ○ |
| 3 | 28.6 | | 33.7 | | 15.0 | 22.7 | 8060 | −0.0008 | 111 | ○ |
| 4 | 19.2 | | 46.8 | | 34.0 | | 7858 | −0.0010 | 94 | X |
| 5 | 28.2 | 21.3 | 5.0 | | | 45.2 | 6685 | 0.0001 | 146 | X |
| 6 | 28.2 | 16.0 | 10.0 | | | 45.2 | 6436 | 0.0036 | 140 | Δ |
| 7 | 28.2 | 10.0 | 16.0 | | 4.5 | 40.7 | 6648 | 0.0007 | 137 | ○ |
| 8 | 28.2 | 26.6 | | | | 45.2 | 6652 | 0.0039 | 127 | ○ |
| 9 | 26.1 | | 29.7 | 15.3 | 11.4 | 17.5 | 6812 | 0.0017 | 120 | ○ |
| 10 | 34.8 | | 31.4 | | 15.5 | 20.3 | 6808 | 0.0016 | 117 | ○ |
| 11 | 34.8 | | 31.4 | | 16.9 | 16.9 | 6646 | 0.0017 | 113 | ○ |

TABLE 2-continued

| No. | LAP | BA42N | SCA | SAE | YOX | MFG | Correlated color temperature | ◂uv | Index for feeling of contrast | Assessment |
|---|---|---|---|---|---|---|---|---|---|---|
| 12 | 34.8 | | 31.4 | | 20.3 | 13.5 | 6624 | 0.0023 | 106 | X |
| 13 | 27.1 | 13.8 | 3.5 | | | 55.6 | 4937 | 0.0036 | 157 | X |
| 14 | 27.1 | 17.3 | | | | 55.6 | 5045 | 0.0033 | 152 | X |
| 15 | 27.1 | 3.5 | 13.8 | | 11.1 | 44.5 | 4978 | −0.0003 | 145 | Δ |
| 16 | 27.1 | | 17.3 | | 22.2 | 33.4 | 5041 | 0.0015 | 133 | ○ |
| 17 | 23.4 | | 16.6 | 8.6 | 25.7 | 25.7 | 5030 | 0.0015 | 120 | ○ |
| 18 | 27.1 | | 17.3 | | 20.3 | 13.5 | 5085 | 0.0057 | 115 | Δ |
| 19 | 20.8 | | 1.6 | | 38.8 | 38.8 | 2998 | −0.0007 | 141 | ○ |
| 20 | 20.8 | | 1.6 | | 46.5 | 31.0 | 2984 | −0.0003 | 133 | ○ |
| 21 | 20.8 | | 1.6 | | 54.3 | 23.3 | 2956 | −0.0011 | 128 | ○ |
| 22 | 20.8 | | 1.6 | | 62.0 | 15.5 | 2974 | −0.0002 | 122 | X |
| 23 | 21.0 | | 0.8 | | 25.3 | 54.7 | 2783 | 0.0017 | 160 | X |
| 24 | 21.7 | | 1.2 | | 30.8 | 46.4 | 2780 | 0.0014 | 150 | ○ |
| 25 | 22.5 | | 1.5 | | 38.0 | 38.0 | 2780 | 0.0004 | 142 | ○ |
| 26 | 23.7 | | 1.5 | | 44.9 | 29.9 | 2832 | 0.0012 | 135 | ○ |
| 27 | 24.5 | | 1.5 | | 51.8 | 22.3 | 2800 | 0.0019 | 128 | Δ |
| 28 | 25.3 | | 1.5 | | 58.6 | 14.6 | 2773 | 0.0014 | 123 | X |

In Table 2, the sample number of each sample lamp, the kinds of phosphors used and a ratio by weight thereof, a correlated color temperature, a distance of a color point of a test light source from a Planckian locus on the 1960 chromaticity diagram (+ indicates the distance of a color point of a test light source which is present on the upper left side of the Planckian locus, while − indicates the distance of a color point of a test light source which is present on the lower right side of the Planckian locus), an index for feeling of contrast M, and the results of the assessment are shown in columns in this order from the left to the right.

Figure 1:
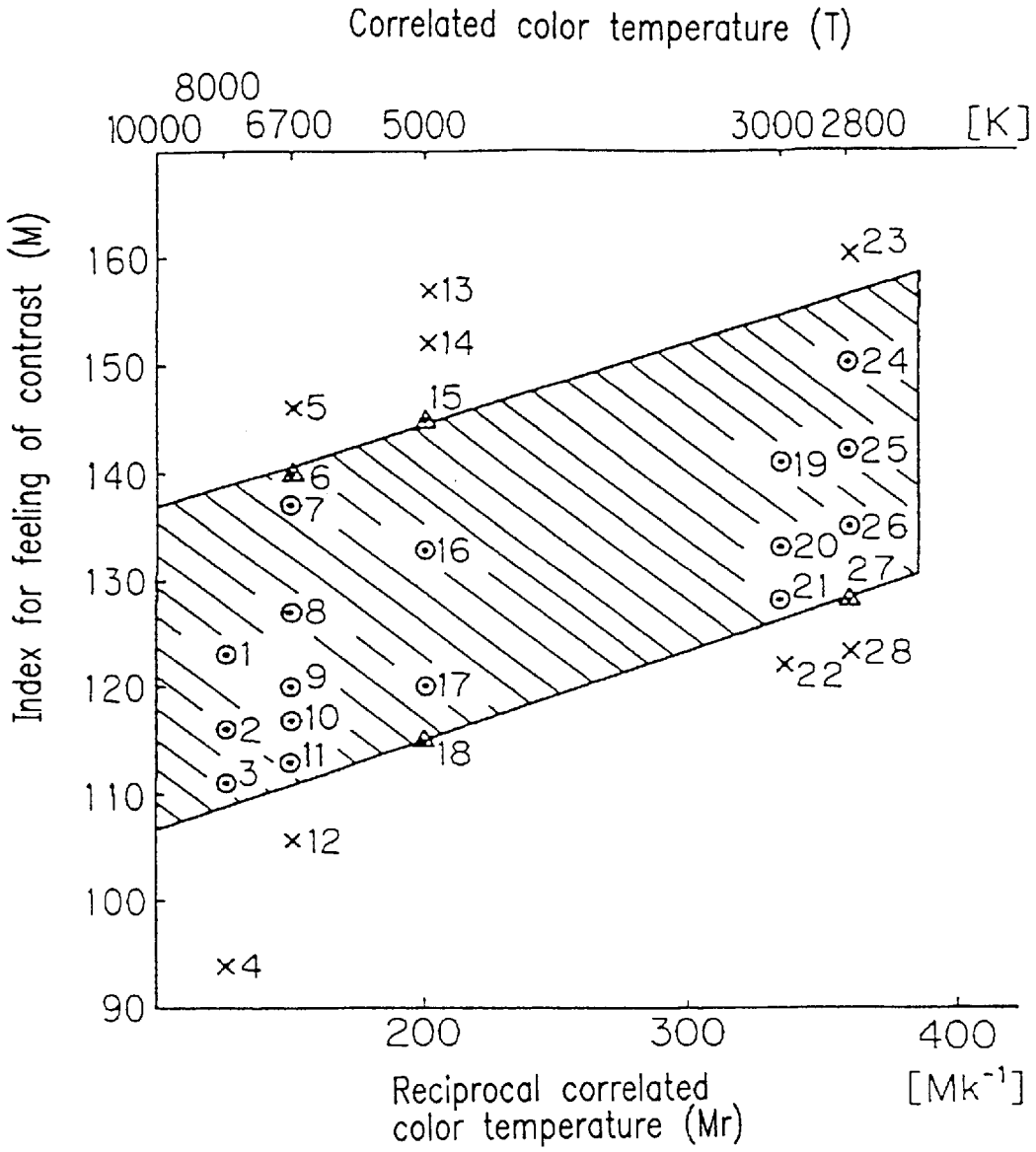
FIG. 1 is a graph showing the relationship between an index for feeling of contrast M, a correlated color temperature T, and a reciprocal correlated color temperature Mr for illustrating the basic concept of the present invention.

As is apparent from Table 2, it is confirmed that the range of the index for feeling of contrast M of the discharge lamp providing a preferable general indoor lighting environment differs depending on the difference of the correlated color temperature. Thus, in FIG. 1, the relationship between a correlated color temperature (T), a reciprocal correlated color temperature ($Mr=10^6/T$) and an index for feeling of contrast M is shown. In FIG. 1, ○, Δ and X indicate the results of the assessment of the discharge lamp; ○ indicates that the discharge lamp is suitable as an indoor lighting environment, Δ indicates that the discharge lamp is at the very limit of being suitable as an indoor lighting environment, and X indicates that the discharge lamp is unsuitable as an indoor lighting environment. In FIG. 1, the points indicated by numbers 1 to 28 correspond to the sample lamps indicated by the same numbers in Table 2. From FIG. 1, it is understood that the range of the index for feeling of contrast M of the discharge lamp capable of providing a suitable lighting environment as general lighting is represented by the hatched area.

Figure 3:
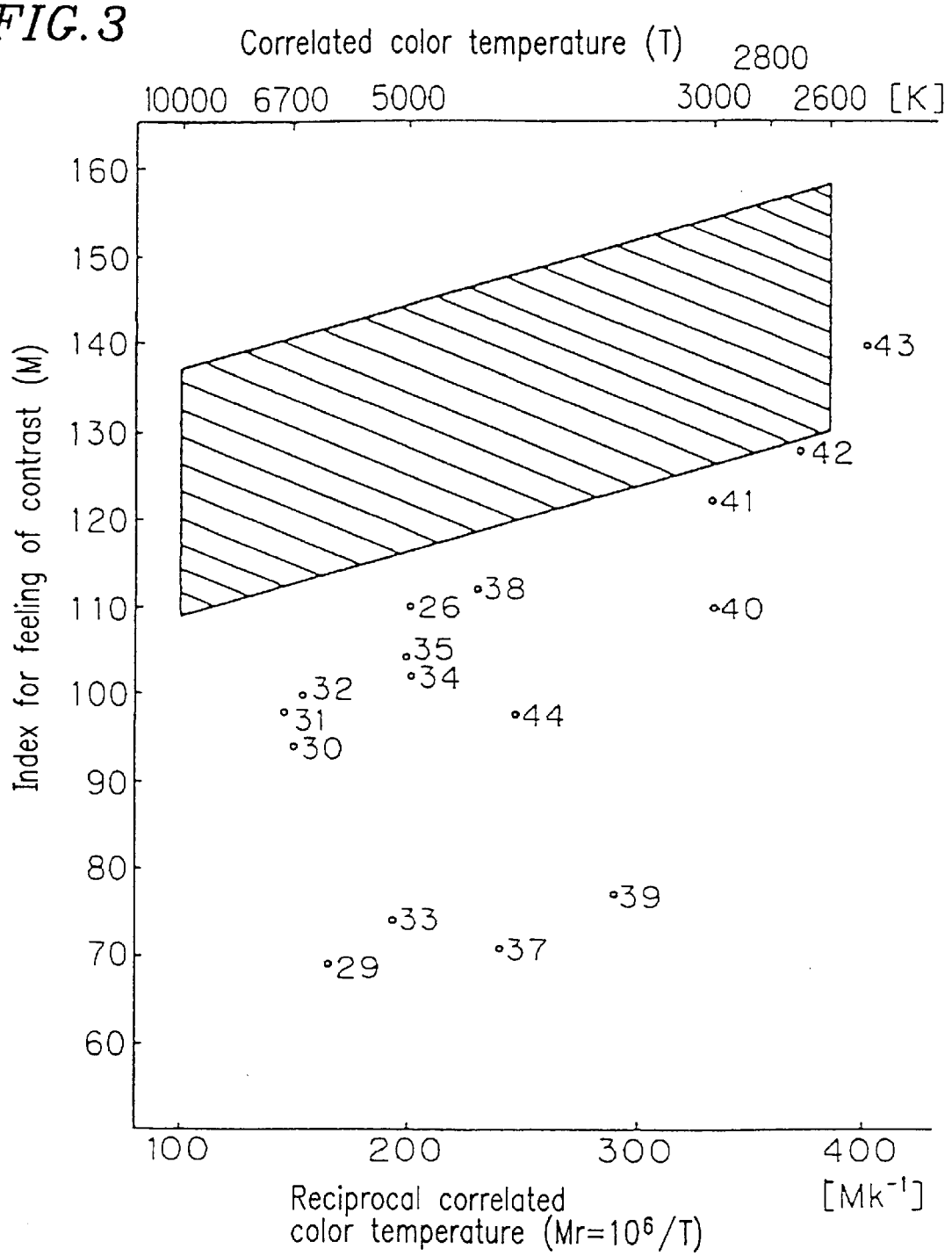
FIG. 3 is a graph showing the relationship between an index for feeling of contrast M, a correlated color temperature T, and a reciprocal correlated color temperature Mr of a conventional discharge lamp.

Next, a calculation is performed for general-purpose discharge lamps which are currently and widely used, thereby obtaining the relationship between a correlated color temperature T, a reciprocal correlated color temperature Mr and an index for feeling of contrast M. The results are shown in FIG. 3. As in FIG. 1, a hatched area in FIG. 3 represents the range of an index for feeling of contrast M of a discharge lamp providing a preferable lighting environment as general lighting obtained by the aforementioned experiment for assessing the sample discharge lamps.

In FIG. 3, points 29 to 44 indicate various kinds of lamps as follows: point 29 for a "daylight" fluorescent lamp (6500 K, Ra 74); point 30 for a tri-band type "daylight" fluorescent lamp (6700 K, Ra 88); point 31 for a "daylight" fluorescent lamp with an improved color rendering property (6500 K, Ra 94); point 32 for a "day light" fluorescent lamp $D_{65}$ with a high color rendering property (6500 K, Ra 98); point 33 for a "neutral" fluorescent lamp (5200 K, Ra 70); point 34 for a tri-band type "neutral" fluorescent lamp (5000 K, Ra 88); point 35 for a "neutral" fluorescent lamp with a high color rendering property (5000 K, Ra 99); point 36 for a "neutral" fluorescent lamp with an improved color rendering property (5000 K, Ra 92); point 37 for a "cool white" fluorescent lamp (4200 K, Ra 61); point 38 for a "cool white" fluorescent lamp with an improved color rendering property (4500 K, Ra 91); point 39 for a "white" fluorescent lamp (3500 K, Ra 60); point 40 for a tri-band type "warm white" fluorescent lamp (3000 K, Ra 88); point 41 for a fluorescent lamp for museums (3000 K, Ra 95); point 42 for a "warm white" fluorescent lamp with a high color rendering property (2700 K, Ra 95); point 43 for a high-pressure sodium lamp having high color rendering properties (2500 K, Ra 85); and point 44 for a metal halide lamp (4230 K, Ra 88).

As is apparent from FIG. 3, no conventional general-purpose lamp is present in the range of the index for feeling of contrast M of the discharge lamps providing a preferable lighting environment as general indoor lighting. The discharge lamps having a correlated color temperature in the range of 2600 K to 10000 K are practically applicable as general-purpose discharge lamps.

From FIG. 1, it is confirmed that a preferable index for feeling of contrast M of a general-purpose discharge lamp is present in such a range that a correlated color temperature T and a reciprocal correlated color temperature Mr ($10^6/T$) satisfy:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(MK^{-1})\ (2600\ K \leqq T \leqq 10000\ K).$$

As described above, by setting the index for feeling of contrast M of a discharge lamp to be in the hatched area of FIG. 1, it is possible to provide a general-purpose discharge lamp and a general-purpose lighting apparatus capable of preferably reproducing the color of a lighting environment.

Hereinafter, with reference to FIGS. 4 to 9, examples of a general-purpose discharge lamp according to the present invention will be described.

FIGS. 4 to 9 are graphs showing relative spectral distributions of fluorescent lamps manufactured as general-purpose discharge lamps. Each of the fluorescent lamps can be manufactured by using the combination of phosphors having peak wavelengths in wavelength bands of 400 nm to 460 nm, 500 nm to 550 nm, and 600 nm to 670 nm, respectively. For example, a phosphor having a peak wavelength in a wavelength band of 400 nm to 460 nm includes: $Sr_2P_2O_7:Eu^{2+}$; $Sr_{10}(PO_4)_6Cl_2:Eu^{2+}$; $(Sr, Ca)_{10}(PO_4)_6Cl_2:Eu^{2+}$; $(Sr, Ca)_{10}(PO_4)_6Cl_2.nB_2O_3:Eu^{2+}$; and $BaMg_2Al_{16}O_{27}:Eu^{2+}$. A phosphor having a peak wavelength in a wavelength band of 500 nm to 550 nm includes: $LaPO_4:Ce^{3+},Tb^{3+}$; $La_2O_3.0.2SiO_2.0.9P_2O:Ce^{3+},Tb^{3+}$; $CeMgAl_{11}O_{19}:Tb^{3+}$; and $GdMgB_5O_{10}:Ce^{3+},Tb^{3+}$. A phosphor having a peak wavelength in a wavelength band of 600 nm to 670 nm includes: $Y_2O_3:Eu^{3+}$; $GdMgB_5O_{10}:Ce^{3+}, Tb^{3+}, Mn^{2+}$; $GdMgB_5O_{10}:Ce^{3+},Mn^{2+}$; $Mg_6As_2O_{11}:Mn^{4+}$; and $3.5MgO.0.5MgF_2.GeO_2:Mn^{4+}$. Hereinafter, some examples of a fluorescent lamp manufactured by using the combination of the aforementioned typical phosphors will be described.

Figure 4:
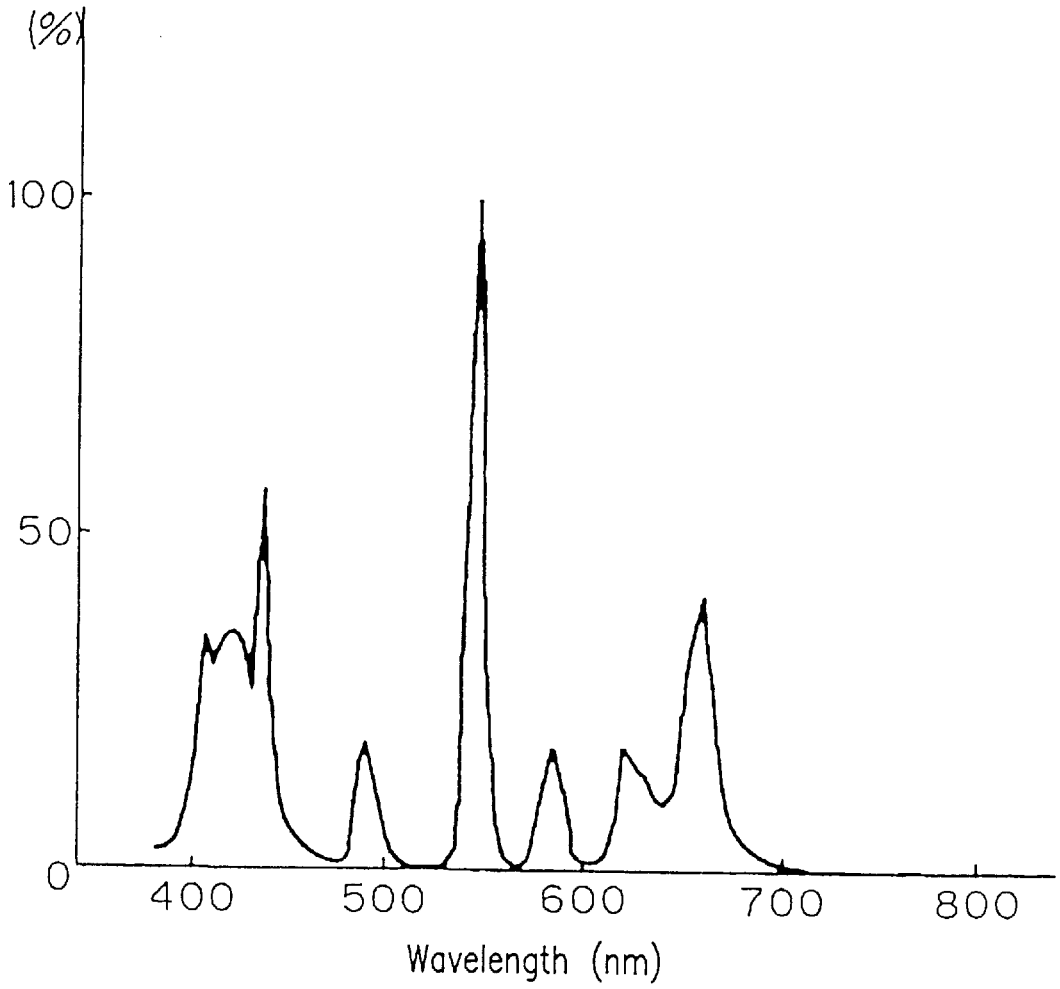
FIG. 4 is a graph showing a spectral power distribution of a discharge lamp according to the present invention.

First, an example of a sample lamp of 6700 K manufactured by using three phosphors will be described. This sample lamp is fabricated by using $Sr_2P_2O_7:Eu^{2+}$, $LaPO_4:Ce^{3+},Tb^{3+}$and $3.5MgO.0.5MgF_2.GeO_2:Mn^{4+}$ at a ratio by weight of about 27:28:45, and corresponds to the sample lamp 8 in Table 2. FIG. 4 shows a relative spectral distribution of this fluorescent lamp.

As can be seen from Table 2, by using $Sr_2P_2O_7:Eu^{2+}$ as a blue phosphor, a discharge lamp having a particularly high index for feeling of contrast can be manufactured. In addition, $Sr_2P_2O_7:Eu^{2+}$ is effective in controlling the redness of skin color. Moreover, as in this example, by using $3.5MgO.0.5MgF_2.GeO_2:Mn^{4+}$ as a red phosphor, in particular, a crimson rose and a red carnation are made to look beautiful and vivid. Thus, this fluorescent lamp has color properties much superior to those of a conventional tri-band type fluorescent lamp.

Figure 5:
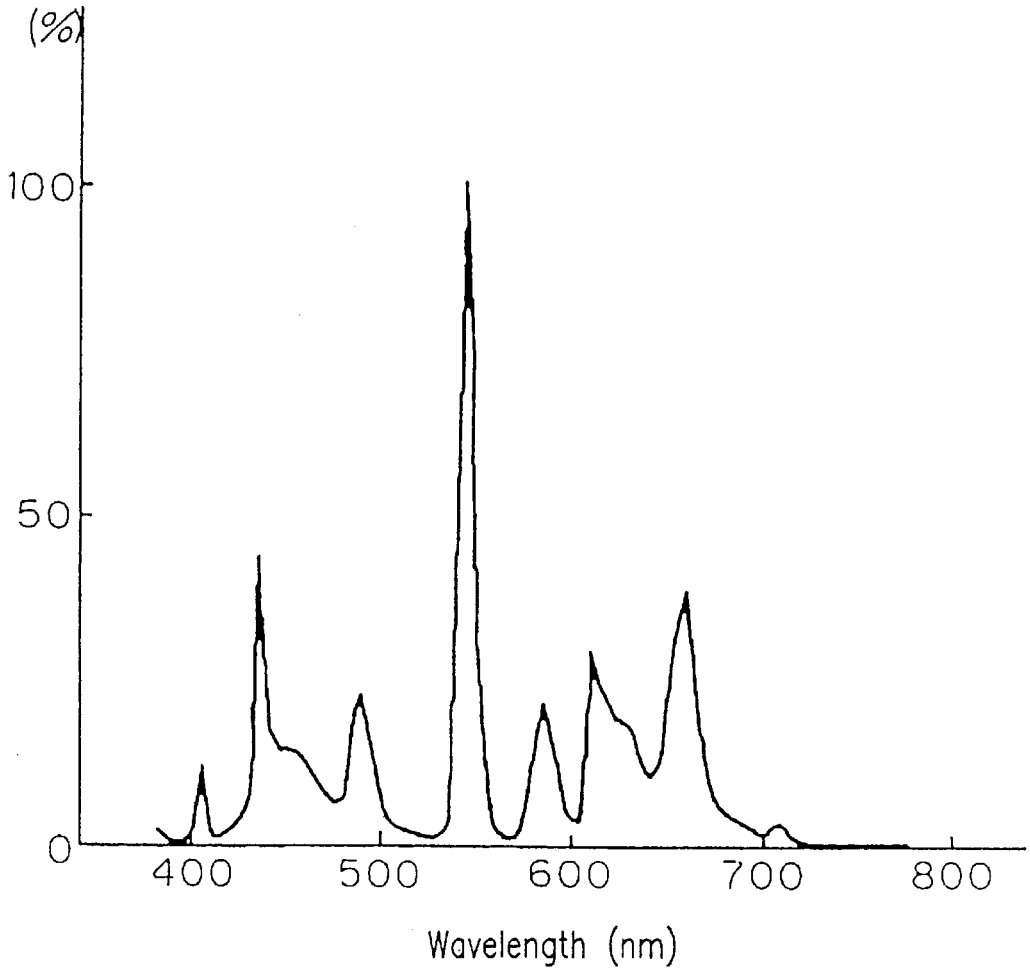
FIG. 5 is a graph showing a spectral power distribution of another discharge lamp according to the present invention.
Figure 6:
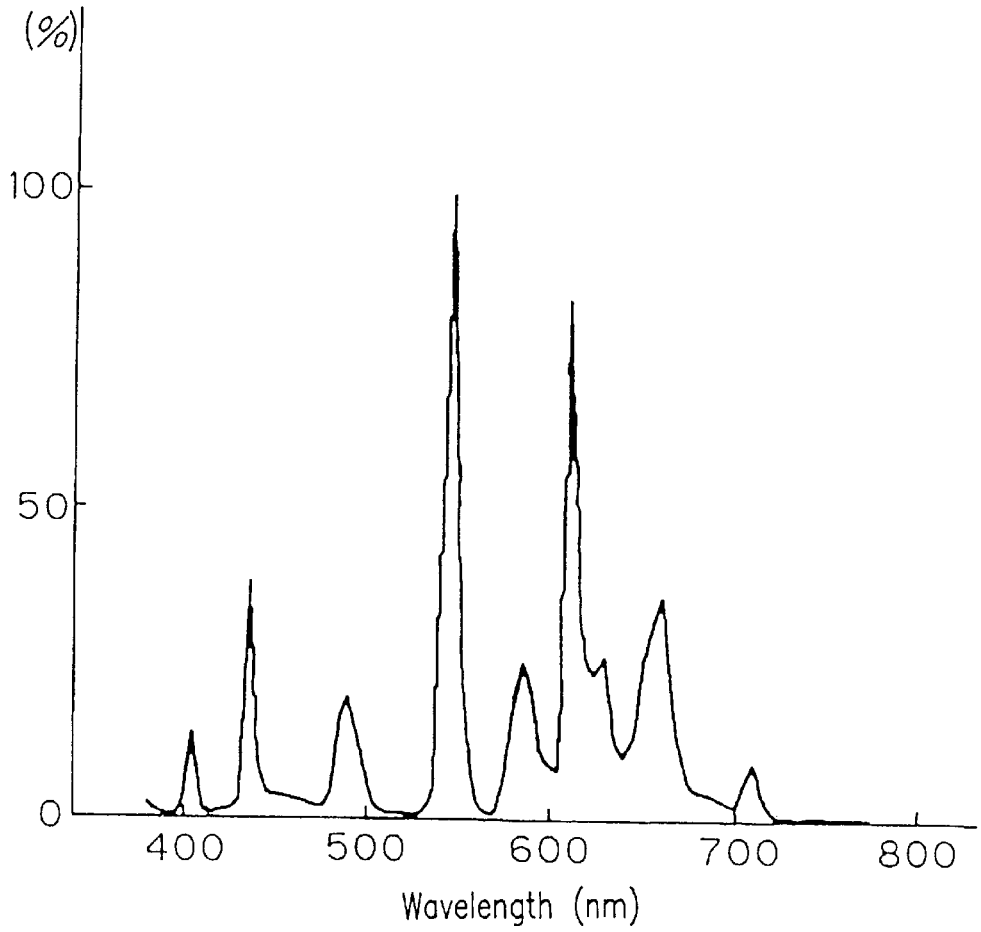
FIG. 6 is a graph showing a spectral power distribution of still another discharge lamp according to the present invention.

Next, examples of sample lamps of 5000 K and 3000 K manufactured by using four phosphors will be described. FIGS. 5 and 6 show relative spectral distributions of these sample lamps, respectively. Both of the sample lamps are manufactured by using: $Sr_{10}(PO_4)_6Cl_2:Eu^{2+}$; $LaPO_4:Ce^{3+}, Tb^{3+}$; $Y_2O_3:Eu^{3+}$; and $3.5MgO.0.5MgF_2.GeO_2:Mn^{4+}$. The sample lamp of 5000 K is manufactured by using the above four phosphors at a ratio by weight of about 17:27:22:33, and corresponds to the sample lamp 16 in Table 2. The sample lamp of 3000 K is manufactured by using the above four phosphors at a ratio by weight of about 1.6:21:47:31, and corresponds to the sample lamp 20 in Table 2. In this way, even when the same combination of phosphors is used, fluorescent lamps having different correlated color temperatures can be manufactured by changing the ratio by weight of combined phosphors.

The sample lamps having the relative spectral distributions shown in FIGS. 5 and 6 manufactured by using the combination of four phosphors can make green such as the green of leaves look beautiful in particular. By adjusting the ratio by weight of the combined phosphors, it is possible to reproduce preferable human skin color. The sample lamp having the relative spectral distribution shown in FIG. 5 can also make skin color preferable. The sample lamp having the relative spectral distribution shown in FIG. 6 has the color properties equivalent to those of an incandescent lamp.

Figure 7:
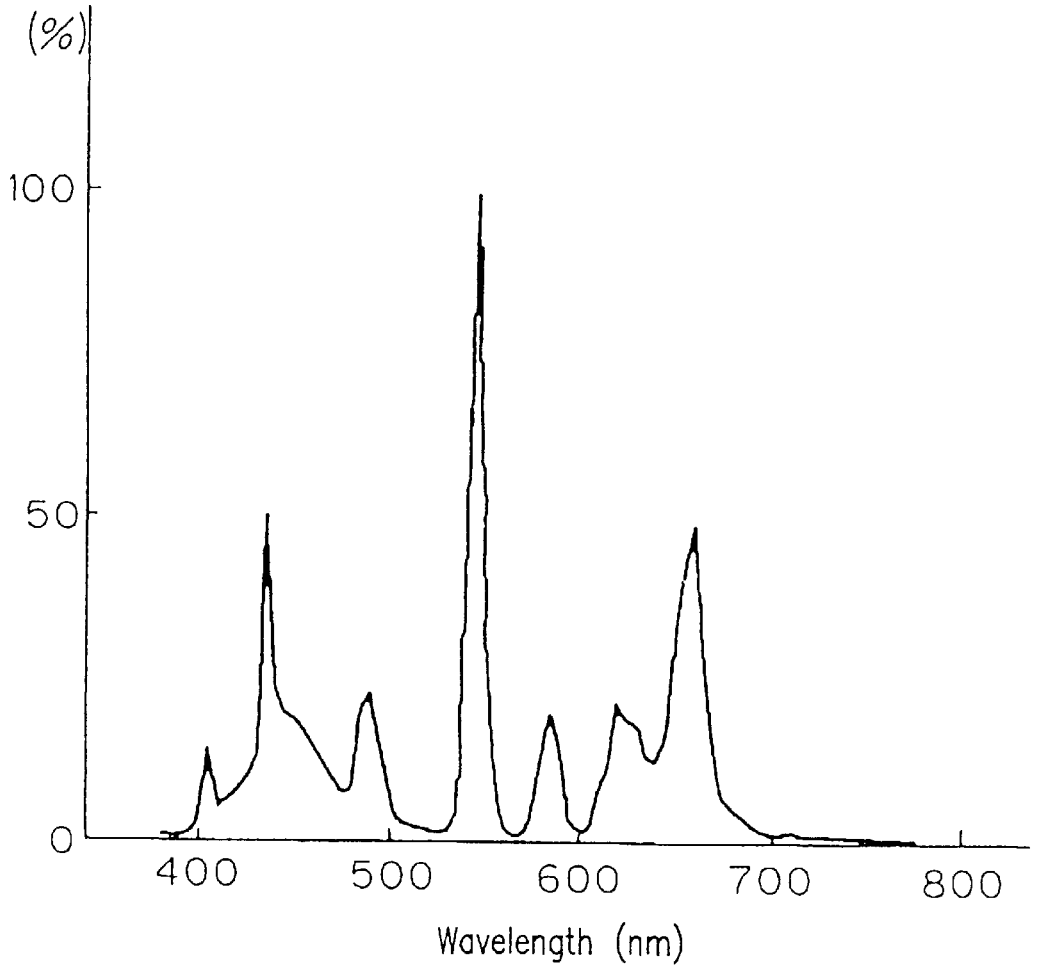
FIG. 7 is a graph showing a spectral power distribution of still another discharge lamp according to the present invention.

Next, an example of a sample lamp of 6700 K manufactured by using five phosphors will be described. FIG. 7 is a graph showing a relative spectral distribution of a fluorescent lamp manufactured by using the combination of: $Sr_2P_2O_7:Eu^{2+}$; $Sr_{10}(PO_4)_6Cl_2:Eu^{2+}$; $LaPO_4:Ce^{3+},Tb^{3+}$; $Y_2O_3:Eu^{3+}$; and $3.5MgO.0.5MgF_2\ GeO_2:Mn^{4+}$ at a ratio by weight of about 10:16:28:4.5:41. The fluorescent of this example corresponds to the sample lamp 7 in Table 2.

Next, an example of a sample lamp manufactured by using the combination including a blue-green phosphor is shown below.

Figure 8:
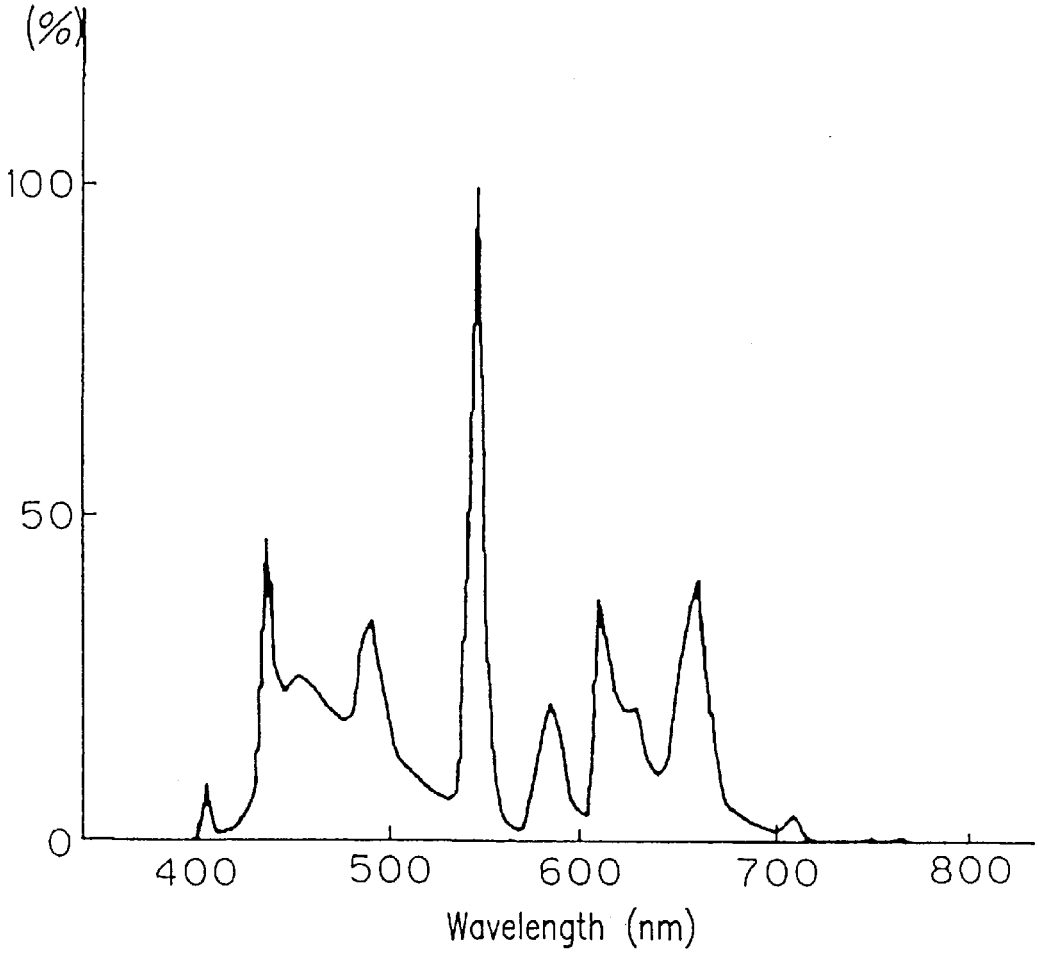
FIG. 8 is a graph showing a spectral power distribution of still another discharge lamp according to the present invention.
Figure 9:
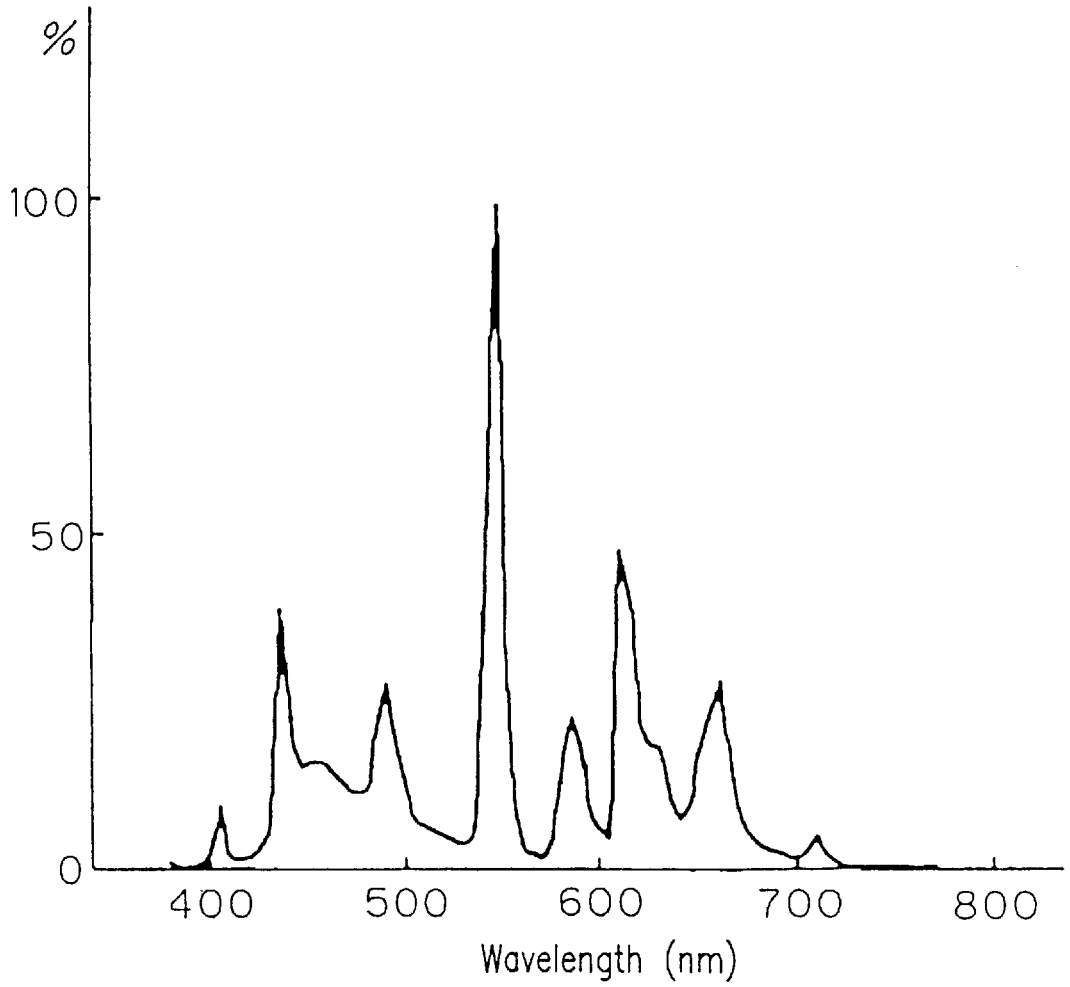
FIG. 9 is a graph showing a spectral power distribution of still another discharge lamp according to the present invention.

FIGS. 8 and 9 are graphs showing relative spectral distributions of fluorescent lamps manufactured by using: $Sr_{10}(PO_4)_6Cl_2:Eu^{2+}$; $Sr_4Al_{14}O_{25}:Eu^{2+}$; $LaPO_4:Ce^{3+},Tb^{3+}$; $Y_2O_3:Eu^{3+}$; and $3.5MgO.0.5MgF_2.GeO_2:Mn^{4+}$. The fluorescent lamp having the relative spectral distribution shown in FIG. 8 is a fluorescent lamp of 6700 K manufactured by using the five phosphors at a ratio by weight of about 30:15:26:11:18, and corresponds to the sample lamp 9 in Table 2. The fluorescent lamp having the relative spectral distribution shown in FIG. 9 is a fluorescent lamp of 5000 K manufactured by using the five phosphors at a ratio by weight of about 17:9:23:26:26, and corresponds to the sample lamp 17 in Table 2.

These fluorescent lamps use $Sr_4Al_{14}O_{25}:Eu^{2+}$ as a blue-green phosphor. This phosphor is effective in reproducing red, yellow, green and blue in a well-balanced manner. In addition, human skin color is preferably reproduced.

Although the examples of the discharge lamps obtained by changing the combination of typical phosphors and the ratio by weight thereof are described above, the present invention is not limited to the examples described above. Sufficient effect of the invention can be obtained by setting the index for feeling of contrast M of the discharge lamp to be in the hatched area in FIG. 1. Moreover, besides the examples described above, it is apparent that various combinations of phosphors can be employed.

As described above, in addition to the effect of obtaining a discharge lamp capable of preferably reproducing color of a lighting environment, various effects can be obtained by varying the combination of phosphors. More specifically, lamps having various features can be manufactured by using different combinations of phosphors in accordance with the design of a color environment to be obtained while keeping an index for feeling of contrast M and a reciprocal correlated color temperature Mr in the range satisfying:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(\mathrm{MK}^{-1})\ (2600\ K \leqq T \leqq 10000\ K).$$

Besides the sample lamps having spectral distributions described above, lamps having particularly remarkable features among the sample lamps used in the experiment of Table 2 will be described.

The sample lamps 1, 2, and 3 in Table 2 have correlated color temperatures T exceeding a correlated color temperature of 7100 K. As described above, the use of $3.5MgO.0.5MgF_2.GeO_2:Mn^{4+}$ as a red phosphor is effective in making red look vivid and beautiful. However, the indoor space is illuminated to look somewhat red as a whole. As a result, it seems as if the lamp had a lower correlated color temperature than an actual correlated color temperature thereof. Therefore, in order to reproduce the color vividly while maintaining a high degree of whiteness and clearness superior to those of a conventional lamp, it is effective to use a lamp having a correlated color temperature T greater than 7100 K and equal to or smaller than 10000 K as the sample lamps 1, 2, and 3 in Table 2.

The sample lamps 23, 24, 25 and 26 in Table 2 have a correlated color temperature T in a warm white region (2600

K≦T≦3150 K). A conventional "warm white" fluorescent lamp, for example, a tri-band type "warm white" fluorescent lamp has a poor ability of reproducing a red color in particular, and has color properties inferior to those of an incandescent lamp. However, the sample lamps 23, 24, 25 and 26 in Table 2 have the color properties at least equivalent to those of the incandescent lamp, and have the color of an illuminant similar to that emitted from the incandescent lamp.

Furthermore, by setting a color point of an illuminant emitted from a fluorescent lamp to be in a region on a 1960 u,v chromaticity diagram so that a distance Δu,v of the color point from a Planckian locus on the 1960 u,v chromaticity diagram is greater than −0.003 and smaller than +0.010, a white wall can be made to look white. Such a fluorescent lamp is suitable as a lamp having a natural lighting color for general lighting. Moreover, by setting the color point of the illuminant emitted from the fluorescent lamp to be in a region on the 1960 u,v chromaticity diagram so that the distance Δu,v is greater than 0 and smaller than +0.010, lamp efficacy can be enhanced.

Figure 11:
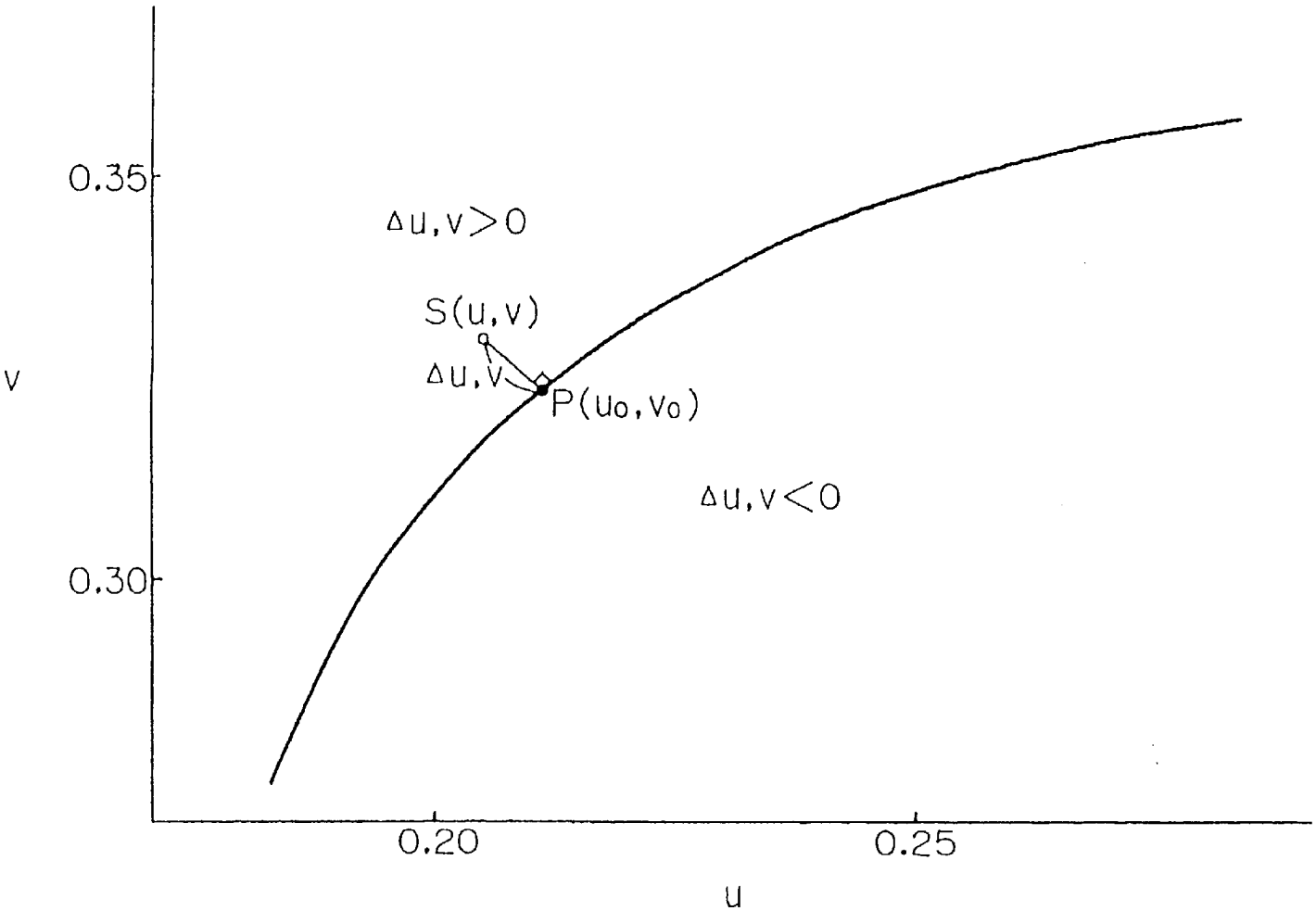
FIG. 11 is a graph showing a distance of color point of a test light source from that of a reference illuminant on the 1960 uv chromaticity diagram.

As shown in FIG. 11, a distance Δu,v of a color point of a test light source from the Planckian locus on the 1960 u,v chromaticity diagram is defined as a distance SP between a color point S and an intersecting point P on the CIE 1960 uv chromaticity diagram, where S(u,v) is a color point of an illuminant from a light source, and $P(u_0,v_0)$ is an intersecting point of a perpendicular line drawn from the color point S to a Planckian locus and the Planckian locus. A distance of a color point of a test light source from that of a reference illuminant on the 1960 u,v chromaticity diagram in the case where the color point S is present on the upper left side (somewhat green illuminant side) of the Planckian locus is defined as positive (Δu,v>0), and in the case where the color point S is present on the lower right side (somewhat red illuminant side) of the Planckian locus, the distance is defined as negative (Δu,v<0).

In the aforementioned example, some examples of the fluorescent lamp according to the present invention are described. It is also possible to realize a high intensity discharge lamp providing an appropriate color environment as in the case of fluorescent lamps. More specifically, by setting an index for feeling of contrast M and a reciprocal correlated color temperature Mr to be in the range satisfying:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(\mathrm{MK}^{-1})\ (2600\ K \leqq T \leqq 10000\ K),$$

it is possible to obtain the same effect as that of the fluorescent lamp described in the aforementioned example.

Figure 10:
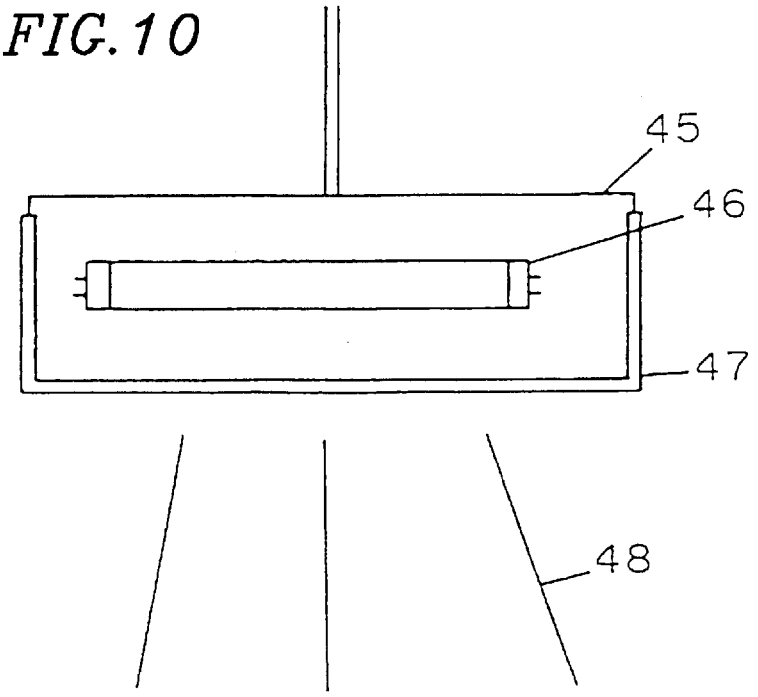
FIG. 10 is a diagram showing a configuration of a general-purpose lighting apparatus according to the present invention.

The same effect as that of the fluorescent lamps described above can be obtained for a lighting apparatus as long as the lighting apparatus has at least either a reflecting plate or a transmitting plate for passing a lighting illuminant therethrough in the relative spectral distributions, for example, as shown in FIGS. 4 to 9. FIG. 10 shows a configuration of a general-purpose lighting apparatus of an example of the present invention.

The lighting apparatus shown in FIG. 10 includes a lighting apparatus body 45, a lamp 46 and a transmitting plate 47. The transmitting plate 47 is manufactured so that a relative spectral distribution of light 48 transmitted through the transmitting plate 47 is identical to, for example, any one of the relative spectral distributions shown in FIGS. 4 to 9 in accordance with the light emitted from the lamp 46. Since the light 48 emitted from the lamp 46 and then transmitted through the transmitting plate 47 has any one of relative spectral distributions of, for example, FIGS. 4 to 9, the relationship between an index for feeling of contrast M, a correlated color temperature T and a reciprocal correlated color temperature Mr satisfies:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(\mathrm{MK}^{-1})\ (2600\ K \leqq T \leqq 10000\ K).$$

Therefore, with such a lighting apparatus, a better color environment can be provided for an indoor space. Sufficient effect of the present invention can be obtained as long as the lighting apparatus of the present invention is designed so that the index for feeling of contrast M of the transmitted light 48 satisfies the aforementioned relation. Therefore, a conventional general-purpose lamp, which is designed to improve a general color rendering index Ra, can also be used as the lamp 46.

Furthermore, a sufficient result of the present invention can be obtained as long as the lighting apparatus of the present invention is designed so that the index for feeling of contrast M of the transmitted light beams 48 satisfies the aforementioned relation. Thus, the same effect can be obtained even when a plurality of lamps are used as the lamp 46. The configuration of a lighting apparatus using a plurality of lamps is shown in FIG. 12.

Figure 12:
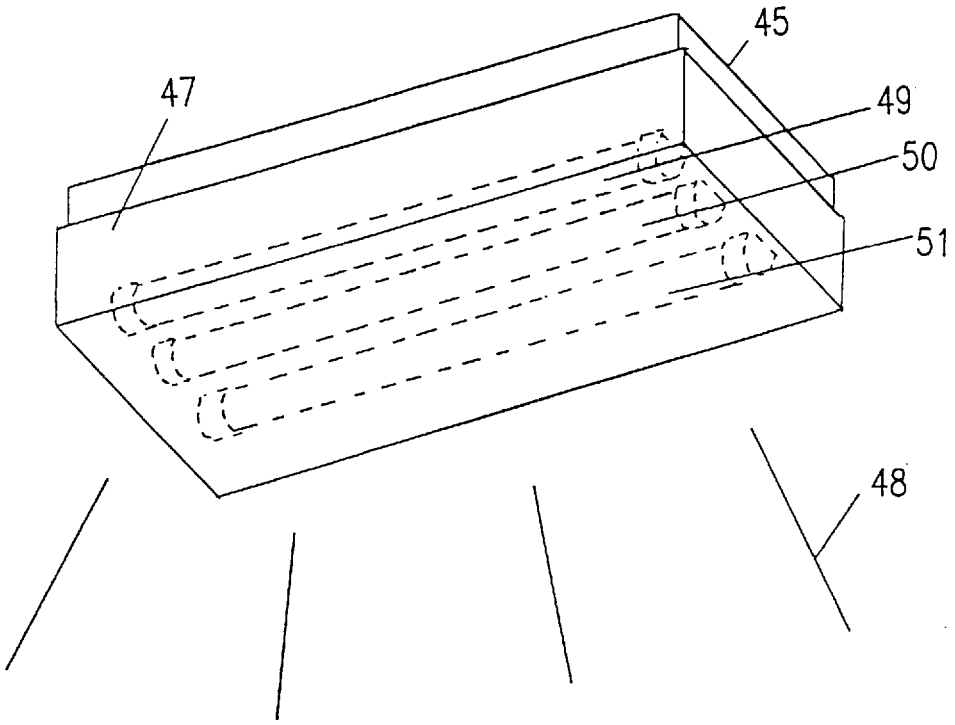
FIG. 12 is a diagram showing a configuration of another general-purpose lighting apparatus according to the present invention.

A lighting apparatus shown in FIG. 12 includes the lighting apparatus body 45, a plurality of lamps 49, 50 and 51 accommodated in the lighting apparatus body 45, and the transmitting plate 47. The lamps 49, 50 and 51 may have respectively different relative spectral distributions. In the case where a plurality of lamps 49, 50 and 51 are used, light beams emitted from the lamps 49, 50 and 51 are mixed and pass through the transmitting plate 47 as the transmitted light beams 48. The transmitting plate 47 is designated in accordance with the light emitted from the lamps 49, 50 and 51 so that the transmitted light 48 has any one of relative spectral distributions shown in FIGS. 4 to 9, for example. Therefore, also in this example, the relationship between an index for feeling of contrast M, a correlated color temperature T and a reciprocal correlated color temperature Mr satisfies:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(\mathrm{MK}^{-1})\ (2600\ K \leqq T \leqq 10000\ K).$$

As a result, a better color environment is provided for an indoor space.

In the example shown in FIGS. 10 and 12, the lighting apparatus using only the transmitting plate designed in accordance with the lamp is shown. However, even when a reflecting plate fabricated in accordance with the lamp so as to have, for example, any one of relative spectral distributions shown in FIGS. 4 to 9, the same effect as that of the aforementioned example can be obtained. Moreover, even when both the transmitting plate and the reflecting plate are employed, the same effect can be obtained if the transmitting plate and the reflecting plate are fabricated so that light emitted from the lighting apparatus as a lighting illuminant has any one of relative spectral distributions shown in FIGS. 4 to 9.

As described above, according to the present invention, a general-purpose discharge lamp and a general-purpose lighting apparatus capable of reproducing the colors of flowers and plants placed indoors so as to further improve a color environment of indoor lighting can be realized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A general-purpose discharge lamp having a reciprocal correlated color temperature Mr and an index for feeling of contrast M, wherein the index for feeling of contrast M and the reciprocal correlated color temperature Mr satisfy relationships:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(\mathrm{MK}^{-1}).$$

2. A general-purpose discharge lamp according to claim 1, wherein a color point of an illuminant color of the discharge lamp is present in a range that a distance of the color point from a Planckian locus on a 1960 uv chromaticity diagram is greater than −0.003 and smaller than +0.010.

3. A general-purpose discharge lamp according to claim 1, wherein a color point of an illuminant color of the discharge lamp is present in a range that a distance of the color point from a Planckian locus on a 1960 uv chromaticity diagram is greater than 0 and smaller than +0.010.

4. A general-purpose discharge lamp according to claim 1, wherein the discharge lamp is a fluorescent lamp and includes a combination -of a green phosphor and a red phosphor, or a combination of a blue phosphor, the green phosphor and the red phosphor, the blue phosphor having a peak wavelength in a wavelength band of 400 nm to 460 nm, the green phosphor having a peak wavelength in a wavelength band of 500 nm to 550 nm, the red phosphor having a peak wavelength in a wavelength band of 600 nm to 670 nm.

5. A general-purpose discharge lamp according to claim 4, wherein the blue phosphor is an $Eu^{2+}$-activated blue phosphor having a peak wavelength in a wavelength band of 400 nm to 460 nm, the green phosphor is a $Tb^{3+}$-activated or $Tb^{3+}$and $Ce^{3+}$-coactivated green phosphor having a peak wavelength in a wavelength band of 500 nm to 550 nm, and the red phosphor is an $Eu^{3+}$-activated red phosphor or a $Mn^{2+}$ or $Mn^{4+}$-activated red phosphor having a peak wavelength in a wavelength band of 600 nm to 670 nm.

6. A general-purpose discharge lamp according to claim 1, wherein the discharge lamp is a fluorescent lamp and includes a combination of a blue-green phosphor, a green phosphor and a red phosphor, or a combination of a blue phosphor, the blue-green phosphor, the green phosphor, and the red phosphor, the blue phosphor having a peak wavelength in a wavelength band of 400 nm to 460 nm, the blue-green phosphor having a peak wavelength in a wavelength band of 470 nm to 495 nm, the green phosphor having a peak wavelength in a wavelength band of 500 nm to 550 nm, the red phosphor having a peak wavelength in a wavelength band of 600 nm to 670 nm.

7. A general-purpose discharge lamp according to claim 6, wherein the blue phosphor is an $Eu^{2+}$-activated blue phosphor having a peak wavelength in a wavelength band of 400 nm to 460 nm, the blue-green phosphor is an $Eu^{2+}$-activated blue-green phosphor having a peak wavelength in a wavelength band of 470 nm to 495 nm, the green phosphor is a $Tb^{3+}$-activated or $Tb^{3+}$ and $Ce^{3+}$-coactivated green phosphor having a peak wavelength in a wavelength band of 500 nm to 550 nm, the red phosphor is an $Eu^{3+}$-activated red phosphor or a $Mn^{2+}$ or $Mn^{4+}$-activated red phosphor having a peak wavelength in a wavelength band of 600 nm to 670 nm.

8. A general purpose discharge lamp according to claim 1, wherein the index for feeling of contrast M is represented by the following equation:

$$M=[G(S,\ 1000(1x))/G(D_{65},\ 1000(1x))]^{1.6}\times100$$

where G(S, 1000(1x)) is a gamut area of four color components under a test light source S and an illuminance 1000(1x), and /G($D^{65}$, 1000(1x)) is a similar gamut area of four color components under a standard illuminant $D^{65}$ and a standard illuminance 1000(1x); and wherein the reciprocal correlated color temperature Mr, in units of $K^{-1}$, is the reciprocal of a temperature of a Planckian radiator whose perceived color most closely resembles that of a given stimulus at a same brightness and under prespecified viewing conditions.

9. A general-purpose lighting apparatus for emitting a lighting illuminant having an index for feeling of contrast M and a reciprocal correlated color temperature Mr, wherein the index for feeling of contrast M and the reciprocal correlated color temperature Mr satisfy relationships:

$$M \geqq 7.5\times10^{-2}Mr+101.5,$$

$$M \leqq 7.5\times10^{-2}Mr+129.5, \text{ and}$$

$$100(MK^{-1}) \leqq Mr \leqq 385(\mathrm{MK}^{-1}).$$

10. A lighting apparatus according to claim 9, wherein the lighting apparatus includes a lamp, and at least one of a reflecting plate and a transmitting plate.

11. A lighting apparatus according to claim 9, wherein the lighting apparatus includes a plurality of lamps.

12. A lighting apparatus according to claim 9, wherein the index for feeling of contrast M is represented by the following equation:

$$M=[G(S,\ 1000(1x))/G(D_{65},\ 1000(1x))]^{1.6}\times100$$

where G(S, 1000(1x)) is a gamut area of four color components under a test light source S and an illuminance 1000(1x), and /G($D^{65}$, 1000(1x)) is a similar gamut area of four color components under a standard illuminant $D^{65}$ and a standard illuminance 1000(1x); and wherein the reciprocal correlated color temperature Mr, in units of $K^{-1}$, is the reciprocal of a temperature of a Planckian radiator whose perceived color most closely resembles that of a given stimulus at a same brightness and under prespecified viewing conditions.

* * * * *